US006473931B2

(12) United States Patent
Chang

(10) Patent No.: US 6,473,931 B2
(45) Date of Patent: Nov. 5, 2002

(54) PAINTING ROLLER ASSEMBLY

(75) Inventor: Chia-Sung Chang, 13, Lane 1, Sec. 1, Chung-Shan Rd., Da-Tsuen Country, Chang-hua County (TW)

(73) Assignee: Chia-Sung Chang, Taichung (TW)

( * ) Notice: Subject to any disclaimer, the term of this patent is extended or adjusted under 35 U.S.C. 154(b) by 0 days.

(21) Appl. No.: 09/737,490

(22) Filed: Dec. 18, 2000

(65) Prior Publication Data

US 2002/0029434 A1 Mar. 14, 2002

(30) Foreign Application Priority Data

Sep. 13, 2000 (CN) ..... 00250237 U

(51) Int. Cl.[7] ..... B05C 17/02
(52) U.S. Cl. ..... 15/230.11; 492/13; 492/19
(58) Field of Search ..... 15/230.11; 492/13, 492/19

(56) References Cited

U.S. PATENT DOCUMENTS

| | | | | |
|---|---|---|---|---|
| 2,970,366 | A | * | 2/1961 | Gill |
| 4,209,883 | A | * | 7/1980 | Hawk |
| 5,490,303 | A | * | 2/1996 | Graves |
| 5,979,009 | A | * | 11/1999 | Polzin |

FOREIGN PATENT DOCUMENTS

| | | | |
|---|---|---|---|
| DE | 4219238 | * | 12/1993 |
| FR | 1272880 | * | 8/1961 |
| FR | 2593725 | * | 2/1987 |

* cited by examiner

*Primary Examiner*—Randall E. Chin

(57) ABSTRACT

A painting roller assembly comprises a shaft with first and second wheels rotationally supported thereon, and a plurality of supporting ribs bridged therebetween. The supporting ribs are radially arranged between the wheels. An insert is arranged between the ribs such that each supporting rib is suitably supported by the insert thereby increase the overall rigidity of the ribs. A sponge roller is enveloped onto the wheels and ribs to facilitate painting work.

5 Claims, 4 Drawing Sheets

PAINTING ROLLER ASSEMBLY

FIELD OF THE INVENTION

The present invention relates to a painting roller assembly, and more particularly to a painting roller assembly with an insert incorporated thereof thereby providing uniform tension force to a sponge roller to facilitate constant and reliable painting work.

DESCRIPTION OF THE PRIOR ART

As shown in FIG. 1, a conventional painting roller generally includes a pair of wheels (3A, 4A) and a support (2A) is bridged therebetween. As a result, the support (2A) can be rotated along with the wheels (3A, 4A). A sponge roller (1A) is enveloped onto the support (2A) and the wheels (3A, 4A) to facilitate painting work along a working surface.

Since the support (2A) is bridged between the wheels (3A, 4A), the tension or rigidity of the support (2A) may attenuate after a period of usage. As a result, the painting work will be negatively influenced.

SUMMARY OF THE INVENTION

It is an objective of this invention to provide a painting roller assembly in which a tension roller incorporated thereof thereby providing uniform tension force to a painting roller to facilitate constant and reliable painting work.

In order to achieve the object set forth, a painting roller assembly in accordance with the present invention comprises a shaft with first and second wheels rotationally supported thereon, and a plurality of supporting ribs bridged therebetween. The supporting ribs are radially arranged between the wheels along perimeter of the wheels. An insert is arranged within a space defined by the ribs such that each supporting rib is suitably supported by the insert thereby increase the overall rigidity of the ribs.

BRIEF DESCRIPTION OF PREFERRED EMBODIMENT

Other objects and advantages of the present invention will become apparent from the following detailed description of the preferred embodiments thereof taken in conjunction with the accompanying drawings wherein.

DETAILED DESCRIPTION OF THE PREFERRED EMBODIMENT

Figure 1:
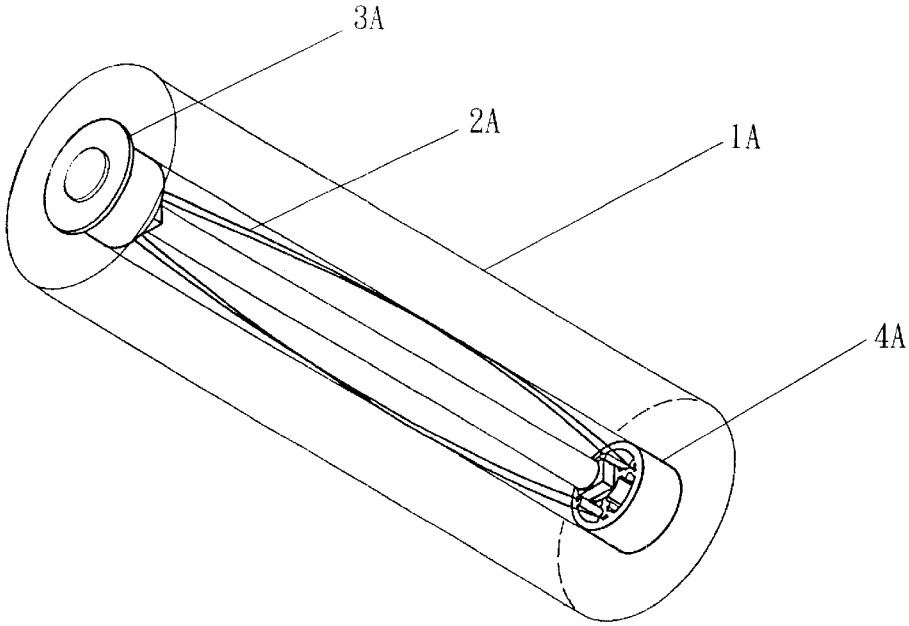
Prior Art Fig. 1
FIG. 1 is a perspective view of a conventional printing roller.
Figure 2A:
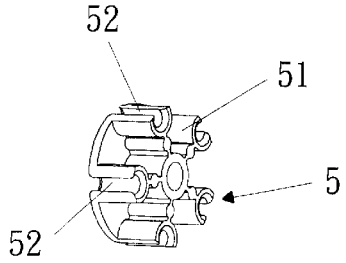
FIG. 2A is a perspective view of an insert in accordance with the present invention.
Figure 2:
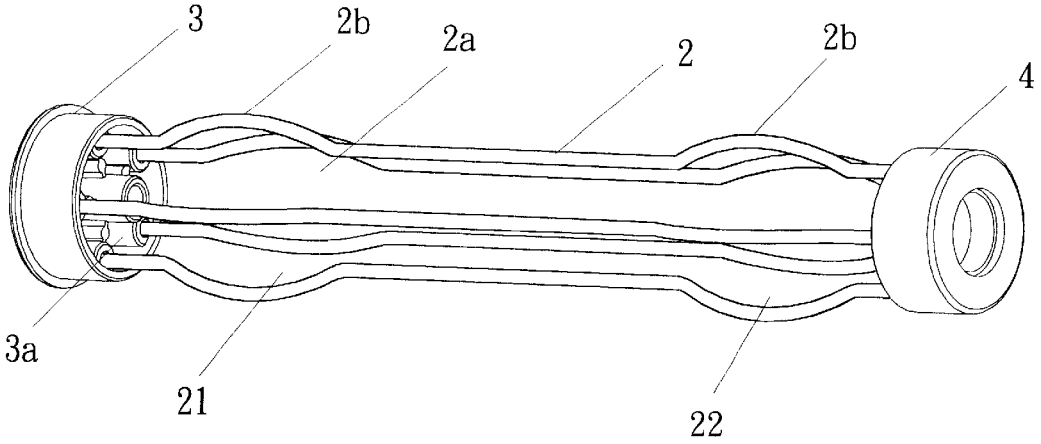
FIG. 2 is an exploded perspective view of a painting roller assembly in accordance with the present invention.
Figure 3:
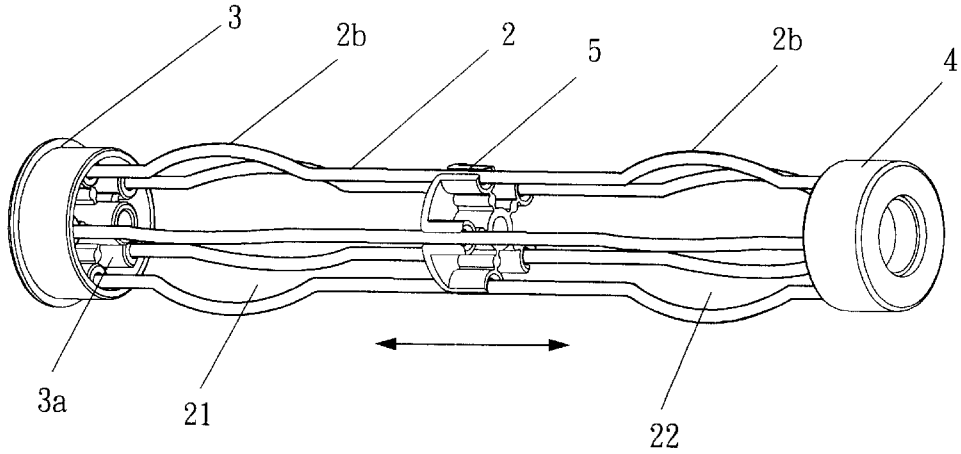
FIG. 3 is an assembled view of FIG. 2.
Figure 4:
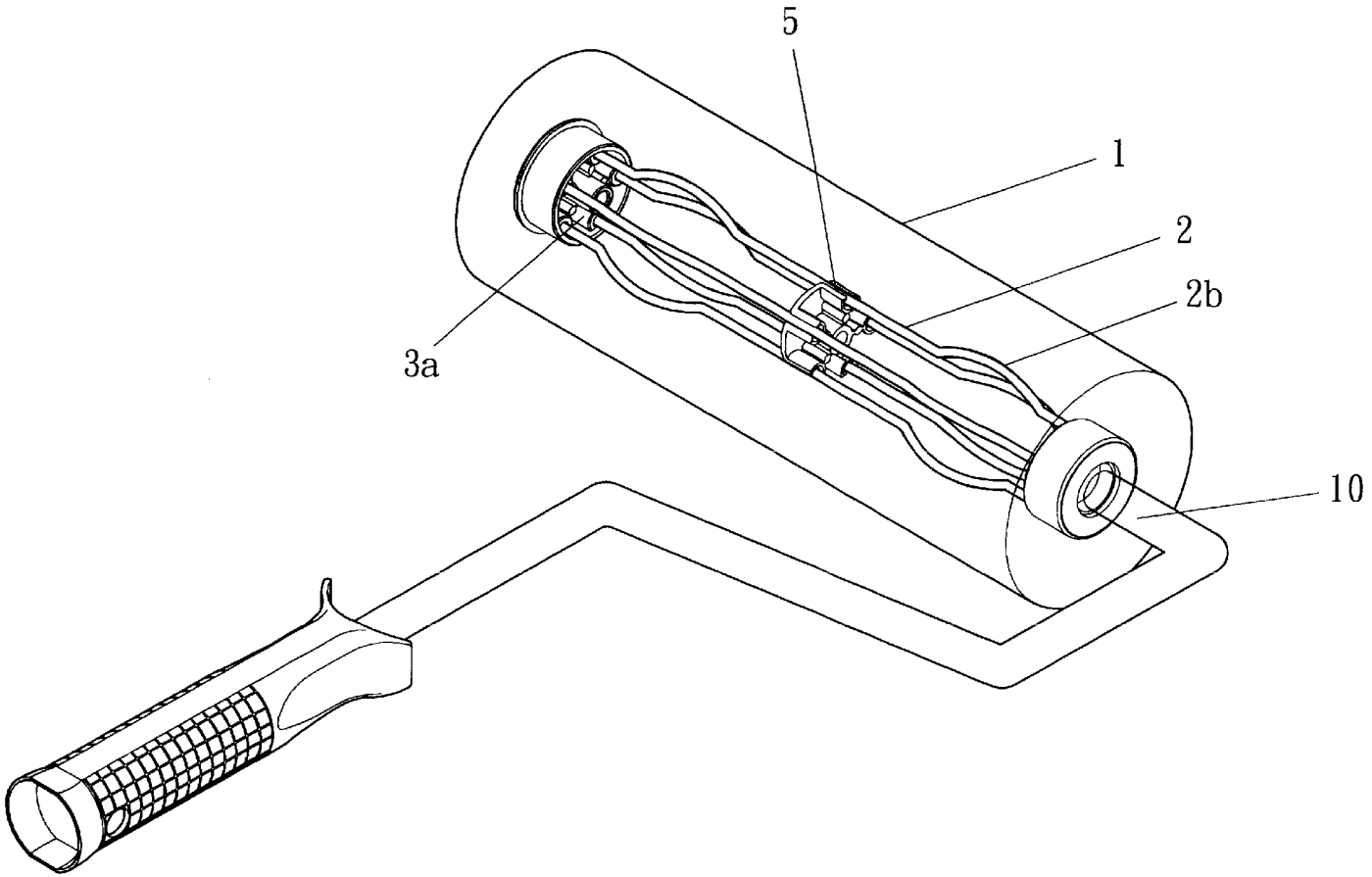
FIG. 4 is an illustrational view showing the painting roller assembly is performing a painting work.

Referring to FIGS. 2, 3 and 4, the painting roller assembly in accordance with the present invention generally comprises a shaft 10 with first and second wheels 3, 4 rotationally attached thereto. The first and second wheels 3, 4 are spaced from each other. The first wheels 3 each defines fives recesses 3*a* radially along its perimeter. The second wheel 4 has the same configuration, but only recesses 3*a* of first wheel 3 are shown. A plurality of supporting ribs 2 is received in the recesses 3*a* of the first and second wheels 3, 4 and defines a space 2*a* therein. Each supporting rib 2 includes at least a curve portion 2*b*. As a result, entrances 21, 22 are defined between two adjacent curve portions 2*b*.

An insert 5 is moveably received in the space 2*a* and defines a plurality of slots 52 formed by extensions 51 thereof. Each slot 52 is arranged with respect to the recesses 3*a* and is dimensioned such that each rib 2 can be properly received and supported therein. Since the insert 5 can be arranged in the middle point between the wheels 3, 4, thereby largely increasing the rigidity of the ribs 2 through its length.

In assembling the insert 5 to the supporting ribs 2, the insert 5 can be readily disposed into the space 2*a* through one of the entrances 21, 22. Then each rib 2 can be fixedly received into the corresponding slot 52. As a result, the rigidity of the ribs 2 through its length can be largely increased by the provision of the insert 5. Then the sponge roller 1 can be enveloped onto the wheels 3, 4, and the ribs 2 for facilitating painting work. Since the rigidity of the ribs 2 is increased, the painting work can be readily done.

While specific illustrated embodiment has been shown and described, it will be appreciated by those skilled in the-art that various modifications, changes, and additions can be made to the invention without departing from the spirit and scope thereof as set forth in the following claims.

I claim:

1. A painting roller assembly, compring a handle with a shaft extending therefrom;

a first wheel rotationally supported on said shaft;

a plurality of supporting ribs radially attached to said first wheel;

a second wheel attached to free ends of said supporting ribs and rotated together with said first wheel; and supporting means arranged between said ribs such that rigidity of said ribs along its length is increased;

wherein said first and second wheels include a plurality of recesses for fixedly receiving ends of said ribs.

2. A painting roller assembly, comprising a handle having a shaft extending therefrom;

first and second wheels rotationally attached to said shaft and spaced apart from each other;

a plurality of supporting ribs bridged between said first and second wheels, and defining a space therein; and an insert received in said space such that each supporting rib is properly supported by said insert;

wherein said insert includes a plurality of slots corresponding to said supporting ribs for securely supporting said ribs therein.

3. The painting roller assembly as recited in claim 2, wherein each rib includes at least a curve portion thereby providing an entrance between two adjacent curve portions to said space.

4. The painting roller assembly as recited in claim 2, wherein said first and second wheels include a plurality of recesses for fixedly receiving ends of said ribs.

5. The painting roller assembly as recited in claim 2, further comprising a sponge roller enveloped onto said wheels and said ribs to facilitate painting work.

* * * * *